US005181938A

United States Patent [19]

Krismer et al.

[11] Patent Number: 5,181,938

[45] Date of Patent: Jan. 26, 1993

[54] COBALT-BOUND DIAMOND TOOLS, A PROCESS FOR THEIR MANUFACTURE AND THEIR USE

[75] Inventors: Bruno E. Krismer, Goslar; Georg Nietfeld, Bad Harzburg, both of Fed. Rep. of Germany

[73] Assignee: Hermann C. Starck Berlin GmbH & Co., Berlin, Fed. Rep. of Germany

[21] Appl. No.: 654,761

[22] Filed: Feb. 4, 1991

[30] Foreign Application Priority Data

Mar. 7, 1990 [DE] Fed. Rep. of Germany ..... 4007057

[51] Int. Cl.[5] ..... B24D 3/00

[52] U.S. Cl. ..... 51/293; 51/307; 51/309

[58] Field of Search ..... 51/307, 309

[56] References Cited

U.S. PATENT DOCUMENTS

| | | | |
|---|---|---|---|
| 2,210,039 | 8/1940 | Petrie | 51/293 |
| 3,141,746 | 7/1964 | De Lai | 51/307 |
| 4,018,576 | 4/1977 | Lowder et al. | 51/309 |
| 4,069,073 | 1/1978 | Tadokoro et al. | 75/349 |
| 4,142,872 | 3/1979 | Conradi | 51/309 |
| 4,231,762 | 11/1980 | Hara et al. | 51/307 |
| 4,268,276 | 5/1981 | Bovernkerk | 51/307 |
| 4,439,237 | 3/1984 | Kuminitsu et al. | 75/243 |
| 4,621,031 | 11/1986 | Scruggs | 51/307 |
| 4,767,455 | 8/1988 | Jourdan | 75/610 |
| 4,778,486 | 10/1988 | Csillag et al. | 264/60 |
| 4,907,377 | 3/1990 | Csillag et al. | 51/309 |
| 4,959,929 | 10/1990 | Burnand et al. | 51/307 |
| 4,971,624 | 11/1990 | Clark et al. | 427/227 |

*Primary Examiner*—Mark L. Bell
*Assistant Examiner*—Willie J. Thompson
*Attorney, Agent, or Firm*—Jerry Cohen; Harvey Kaye

[57] ABSTRACT

Cobalt-bound diamond tool (e.g. for cutting, drilling polishing) composite materials comprising diamond particles in uniform matrix of cobalt-boron alloy with 1-5 weight percent and uniform, stable and controllable matrix hardness of about 200 to 650 $HB_{30}$.

9 Claims, No Drawings

COBALT-BOUND DIAMOND TOOLS, A PROCESS FOR THEIR MANUFACTURE AND THEIR USE

The present invention relates to boron-containing, cobalt-bound diamond materials formed as tools, to a process for the preparation of such materials and tools and to their use.

Cobalt bound diamond tools, e.g. frame and cable saws or drill bits for rock, are made of pressed and sintered mixtures of diamond powder and cobalt metal matrix powder. The cobalt metal must be adapted in hardness and ductility to its particular use.

When rock is drilled or cut with diamond cutting tools, an erosion must be formed behind the diamond grains so that the rock dust produced can be washed out and carried away from cooling liquid.

If the matrix metal is too soft, the erosion becomes too deep due to the abrasive action of the rock dust and the diamonds drop prematurely out of the binder metal and are then no longer available for the cutting process. If the binder metal is too hard, the area eroded will be too small or there will be no erosion. The rock dust then cannot be removed and the cutting action rapidly diminishes. For high quality rock saws and/or drills, the matrix metal in which the diamonds are embedded must be accurately adapted to the hardness of the rock. Workers of large marble quarries in particular require the manufacturers of the tools to provide saws or parts of saws accurately made to measure their material.

The matrix metal in the sintered parts of technically pure cobalt metal powder has Brinell hardness of about 200 $HB_{30}$ after hot pressing at 930° C. to 980° C. This hardness depends on the morphology of the powder and on the nature and quantity of the elements present as impurities. The oxygen content of the cobalt metal powder also plays a role in establishing hardness.

Various doping agents are known as hardeners for sintered bodies containing cobalt as matrix metal: metals, silicides and carbides of groups 4b, 5b and 6b of the Periodic Table. A particularly valuable role is played by the element boron whose action as hardener for various metals, in particular for metals of the iron group, is well known. The so-called "Nibodur" TM process of BAYER AG has become particularly important. It is used for coating materials with nickel or cobalt. In this process, the currentless (i.e. not electrolytic nor electrophoretic) chemical deposition of the boron-containing metals, particularly nickel, is used for the surface coating and hardening of materials, as described in the laid-open German Patent application DE-OS 12 34 493.

According to Japanese published application JP-A 57/38377, cobalt coated diamond powder is used among others for the production of cobalt bound diamond tools which in addition contain carbidic substances as mechanically resistant materials.

The coating of diamonds with cobalt or nickel is intended to enable the diamonds to become more firmly bound in the matrix metal. If the bond between the matrix metal and the surface of the diamonds is insufficient, the diamonds will break out during the cutting process and be lost to the process. If the hot pressing and sintering temperature is increased to improve the bonding inclusion of the diamonds, the surfaces are attacked and the diamonds form carbidic zones with the matrix metal, and further increase in temperature destroys the diamonds. The coating of the diamonds, however, does not affect the hardness of the matrix metal.

Diamond tools produced by this process have numerous regions of inhomogeneity because the hard phases of the matrix metal occur only on the surface of the diamond particles and at the locations of the particles of hard material. Planned control of the hardness values in the finished tool cannot be achieved by these means.

Departing from the natural hardness and ductility resulting by chance from the components and the morphology of the cobalt metal powders, users frequently demand cobalt metal powders which will fulfill specific hardness conditions in the diamond tools, depending on the particular purpose for which the tools are required, i.e. the predetermined Brinell hardness should be reproducibly adjustable in the region of from 200 to 500 $HB_{30}$.

There have been many attempts to harden cobalt by the addition of other metals, carbides, carbon, borides or silicides. Although this can easily be done, it has a considerable influence on the tribological properties of the matrix metal.

For example, the eroded area behind the diamonds becomes irregular and acquires a superficial roughness, depending on the particle size of the hard materials added. Further, the mixture of the matrix metal with the hard materials must be experimentally determined for optimizing the mixture for a particular type of stone or rock. The experiments required for this purpose are difficult and expensive.

The addition of carbon to cobalt metal powder before hot pressing gives unsatisfactory results since the reaction $C+CoO \rightarrow Co+CO$ is influenced by the hot graphite susceptor and the graphite ram, which also take part in the reaction. This leads to variation in the hardness of the cobalt used as matrix metal.

It is therefore an object of the present invention to provide a diamond tool material which is free from the above-described disadvantages. In particular, the invention is intended to provide a given harness range suitable for the intended use of the diamond tool.

SUMMARY OF THE INVENTION

This object is fulfilled by boron-containing, cobalt-bound diamond tools material comprising boron-containing cobalt metal as matrix metal with diamonds embedded therein, the matrix metal containing from 0.1 to 5% by weight of boron uniformly distributed therein. The diamond tools according to the invention have a specified hardness which depends on their boron content and remains constant even after the tools have been in use. The matrix metal according to the invention preferably has a Brinell hardness in the region of 200 to 650 $HB_{30}$.

The substantially homogeneous hardening of the cobalt metal matrix powder, which is an important feature of the present invention, can be achieved at temperatures far below the melting point of the matrix metal if the matrix metal is a cobalt metal powder which has been prealloyed with boron and if this matrix metal is used as such or in admixture with udoped (pure) cobalt metal powder for the powder metallurgical manufacture of diamond tools.

The present invention thus also relates to a process for the manufacture of the diamond tools according to the invention.

DETAILED DESCRIPTION OF PREFERRED EMBODIMENTS

In one preferred embodiment of the invention, the diamond tools are obtained by pressing and sintering mixtures of diamond powder and matrix metal powder, using, as matrix metal powder, a cobalt powder prealloyed with boron and containing 1 to 5% by weight of boron.

Another embodiment of the process for the manufacture of the diamond tools also preferred according to the invention, comprises pressing and sintering mixtures of diamond powder and matrix metal powder and is characterised in that the matrix metal powder is produced with a boron content of 1 to 5% by weight by mixing prealloyed cobalt-boron powder with pure cobalt metal powder.

Suitable prealloyed cobalt-boron powders may be obtained, for example, by mechanically breaking down a cobalt-boron alloy which has been produced metallothermically or they may also be obtained advantageously by injecting inert gas into boron-containing cobalt melt to form a powder with grain sizes $<500$ μm (microns), which is then fine milled by attrition grinding for further reduction of the grain sizes.

The object of the invention is not achieved with mixtures of pure cobalt powder with pure amorphous or crystalline boron.

Another preferred embodiment of the process according to the invention consists in that the boron content of the prealloyed cobalt-boron powder is introduced into the cobalt metal powder by chemical reduction of cobalt salt solutions by means of boron hydride compounds, preferably alkali metal boranates. The cobalt metal powders obtained by this embodiment of the process mainly have an average particle size of $<5$ μm.

If the cobalt-boron alloy powders prepared by chemical reduction and/or by metallurgical processes are mixed with pure cobalt metal powder to adjust the matrix metal to the required boron content, it is surprisingly found that the same object is achieved as with "in situ" alloyed Co-B powders which are used unmixed. The pure cobalt metal powder used as admixture is prepared by the usual method of reducing finely divided cobalt oxide with hydrogen.

The present invention also relates to the use of the diamond tools according to the invention for cutting, drilling and polishing stone, metal, glass, concrete, ceramics and other mineral materials.

The invention is described in the following Examples which are to be regarded as purely explanatory and illustrative and not as restricting. The test samples for determining the hardness were prepared as follows:

EXAMPLE 1

Chemical Reduction of Cobalt Salts 14 kg of $CoCl_2.6H_2O$, 17.5 kg of K-Na tartrate and 8 kg of NaOH were dissolved in 70 l of $H_2O$ in a stirrer vessel with stirring while the temperature was maintained at 40° C. A total of 2.1 kg of $KBH_4$ was slowly added portionwise to the resulting solution for reduction while the temperature in the reaction vessel was kept constant at 50° C. 2 liters (1) of 50% hydrazine hydrate solution were then added for complete reduction. The Co-B powder thus obtained was filtered off, washed several times with water and then dried at 40° to 50° C. at reduced pressure. 3.6 kg of Co-B powder having a boron content of 3.0% were obtained. The hot pressed samples were found to have an average Brinell hardness by $HB_{30}440$.

EXAMPLE 2

Chemical Reduction of Cobalt Salts 30 kg of $CoCl_2.6H_2O$, 37.5 kg of K-Na tartrate and 17.1 kg of NaOH were dissolved in 250 l of water in a 400 l stirrer vessel as in Example 1. Reduction was then carried out by the addition, in small portions, first of 4.5kg of $KBH_4$ and then of 4.5 l of hydrazine solution. After the reduction, the mixture was heated to 80° C. and then filtered, washed several times with water and dried as in Example 1.

7.65 kg of Co-B powder having a boron content of 5.0% were obtained. An average Brinell hardness of $HB_{30}600$ was measured on the hot pressed samples.

This cobalt boron powder was also used for mixing with pure cobalt metal powder.

EXAMPLE 3

Boron Doping With Cobalt Boron Alloy

A cobalt boron alloy containing 15.5% by weight of boron was prepared by aluminothermal reduction of cobalt oxide, boron oxide and aluminium grit and the product was size reduced to a coarse powder with a grain size of $<3$ mm. Subsequent further size reduction in an attritor with inert liquid (hexane) yielded a fine alloy powder having a grain size of $<20$ μm and the following grain size distribution:

80% by wt. $<5$ μm;

95% by wt. $<10$ μm;

5% by wt. $>10$ μm to $<20$ μm.

This cobalt boron powder was used for mixing with pure cobalt metal powder.

EXAMPLE 4

Mixtures of the Co-B alloy powders, prepared as in Examples 1-3 above of Examples 1 to 3 with pure cobalt metal powder were used as starting powders for the test samples. The samples were prepared by hot pressing the metal powders for 5 minutes at 960° C. and 30 MPa. The Brinell hardness was then measured on the sintered products. Table 1 below shows the results of the hardness measurements carried out on sintered products obtained from mixtures of metallothermically produced boron doped cobalt metal powder and pure cobalt powder. The results obtained with the comparison substance (unmixed Co-B alloy by metallothermic reduction) indicates that the effect is reversed when relatively high boron contents outside the range of the invention are used.

TABLE 1

| Boron Content | Brinell Hardness ($HB_{30/1}$) |
|---|---|
| 1.0% by wt. | 280 |
| 2.0% by wt. | 300 |
| 3.0% by wt. | 420 |
| 4.0% by wt. | 500 |
| 5.0% by wt. | 650 |
| 14.4% by wt. (Comparison) | 395 |

Table 2 below shows hardness measurements obtained on sintered products of boron-doped cobalt metal powder prepared by chemical reduction with boronates ($KBH_4$ reduction).

The relatively low initial hardness are due to the high degree of purity of the boron-doped cobalt metal obtained by chemical reduction. The low initial hardnesses are due to the high degree of purity of the cobalt content, Cobalt Monograph, Centre d'Information due Cobalt, Brussels 1960, page 95. The effect of boron doping according to the invention is thus also obtained with very pure cobalt.

TABLE 2

| Boron Content | Brinell Hardness ($HB_{30/1}$) |
|---|---|
| 1.0% by wt. | 190 |
| 2.0% by wt. | 240 |
| 3.0% by wt. | 440 |
| 4.0% by wt. | 500 |
| 5.0% by wt. | 550 |

The diamond tool products which can be made in enhanced form and/or enhanced manufacturing processes comprise the above described materials formed as cutting, sawing, drilling or polishing tools or as tips, edges, teeth or other inserts or facings for such tools. The tools may be tailored in ways well known in the art to use with stone or rock, glass, metal, concrete, ceramics and other mineral materials and of large scale (e.g., for massive mining or tunneling equipment or industrial grinders) or small scale (e.g., dental tools, semiconductor ingot or wafter slicing and dicing cutters or other forms of micro-machining equipment) and in-between (e.g. marble saws, cut-off wheels, abrasion belts, disks and pads, grinding sticks, oil drilling and inserts therefor).

As noted above the hardness of the material is uniform, stable and controllable to a desired level to control erosion for a particular specification range and to achieve the foregoing benefits avoiding or reducing the use of adverse phase inclusions at the diamond particle surfaces or within the matrix and avoiding or reducing reliance on diamond particle morphology to control particle/matrix bondings and also avoiding adverse pressure/temperature schedules in tool production. Arbitrary disturbance of matrix metal powder morphology is also avoided.

The foregoing enhancements of product and process are achieved at favorable cost and with the added benefit of simplifying diamond tool production and usage technologies.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

We claim:

1. Cobalt-bound diamond tool comprising dispersed particles of diamond in a matrix consisting of cobalt and a uniform dispersion thereon of alloyed fine particles of boron, the overall boron content of the matrix being in the range of 0.1 to 5.0 weight percent of the matrix, the boron containing particles being of less than 5 micron size and provided in an amount and sufficiently dispersed in the cobalt to effect controllable and maintainable-in-use homogeneous matrix hardness at a selected level in the range of 200 to 650 HB 30.

2. The product of claim 1 wherein the matrix comprises distinct boron-cobalt alloy particles uniformly dispersed in an essentially pure cobalt phase.

3. The product of claim 2 wherein the alloy particles are pre-alloyed, i.e. not formed in-situ in the matrix.

4. The product of claim 1 wherein the matrix consists essentially of a pre-alloyed boron-cobalt alloy.

5. A process for the manufacture of diamond tools comprising the steps of mixing diamond powder particles with cobalt containing particles and bonding the mixture to a solid article form, at least a portion of said cobalt containing particles also containing boron, the selection of materials, mixing and bonding being controlled to produce a uniform dispersion of diamond particles in a matrix consisting of cobalt, with boron in an amount of 1 to 5 weight percent of the matrix uniformly dispersed in the matrix, in the resultant bonded product.

6. A process for the manufacture of diamond tools according to claim 5 wherein the matrix metal powder is produced with a boron content of from 1 to 5% by weight by mixing prealloyed cobalt-boron powder with a cobalt metal powder.

7. A process according to claim 6, wherein the boron content of the prealloyed cobalt-boron powder is introduced into the cobalt metal powder by the chemical reduction of cobalt salt solutions by means of boron hydride compounds.

8. A process according to claim 7 wherein the boron hydride compounds comprise one or more alkali metal boranates.

9. A process according to claim 6, wherein the boron content of the prealloyed cobalt-boron powder is introduced by metallothermic reduction.

* * * * *